US005371917A

United States Patent [19]

Hoagland

[11] Patent Number: 5,371,917

[45] Date of Patent: Dec. 13, 1994

[54] BACKPLATE FOR A SPONGE REFILL CARTRIDGE

[75] Inventor: Mary M. Hoagland, Cincinnati, Ohio

[73] Assignee: Vining Industries, Inc., Springfield, Ohio

[21] Appl. No.: 115,527

[22] Filed: Sep. 2, 1993

[51] Int. Cl.[5] ..... A47L 13/257

[52] U.S. Cl. ..... 15/244.1; 15/118

[58] Field of Search ..... 15/116.2, 119.2, 147.1, 15/147.2, 145, 176.1, 176.4–176.6, 228, 244.1, 118

[56] References Cited

U.S. PATENT DOCUMENTS

| | | | |
|---|---|---|---|
| 2,204,806 | 6/1940 | Lorenz et al. | 15/119.2 |
| 2,698,955 | 1/1955 | Trindl | 15/228 |
| 2,714,737 | 8/1955 | Le Febvre et al. | 15/119.2 |
| 3,157,901 | 11/1964 | Murphy | 15/119.2 |
| 3,178,748 | 4/1965 | Heepe | 15/119.2 |
| 3,228,054 | 1/1966 | Weber et al. | 15/119.2 |
| 3,616,481 | 11/1971 | Van Spronsen . | |
| 4,127,911 | 12/1978 | Cupp et al. | 15/145 |
| 4,468,830 | 9/1984 | Batchelor | 15/244.1 |
| 4,468,832 | 8/1984 | Batchelor . | |
| 4,509,224 | 5/1985 | Batchelor . | |

FOREIGN PATENT DOCUMENTS

| | | | |
|---|---|---|---|
| 1382759 | 11/1964 | France | 15/244.1 |

*Primary Examiner*—David A. Scherbel
*Assistant Examiner*—Mark Spisich
*Attorney, Agent, or Firm*—Panitch Schwarze Jacobs & Nadel

[57] ABSTRACT

A sponge refill backplate for easy replacement on mop heads having mop clips, turn-lock assemblies or long slotted attachment members comprising opposed raised locking clips open only at their distal ends having locking slots with a wider channel below to receive a mop clip, the locking slot being of sufficient length so that mop clips on a sponge mop head may slide far enough into the locking clip to allow the outer side of the opposite locking clip to fall into place at its attachment without bending the backplate or sponge; and a pair of locking ramps located at the open distal end of each locking clip, angled inwardly toward the open end to assist in loading the refill and which acts as stop members for the mop clips or long slotted attachment members but which may be overridden by a predetermined force in the longitudinal direction of the mop head. This is an advantage over most current sponge refills which require wetting and/or bending the sponge and backplate to attach the refill to the mop head.

5 Claims, 2 Drawing Sheets

BACKPLATE FOR A SPONGE REFILL CARTRIDGE

TECHNICAL FIELD

This invention relates to sponge mop refill cartridge assemblies, specifically backplates thereof.

BACKGROUND ART

Sponge mops are widely used for cleaning and scrubbing a variety of surfaces. Sponge mops generally have an elongated handle with a mop head attached at one end, with a sponge mop refill cartridge attached to the base plate of the mop head. Ideally, the attachment means between the base plate and the sponge mop refill cartridge should allow quick and easy replacement of the refill cartridge while firmly securing the refill cartridge to the base plate during wringing and mopping operations.

Three common attachment means for sponge mop heads include mop clips, long slotted systems and turn-lock assemblies. Unfortunately, replacing current refill cartridges on sponge mop heads with mop clips and long slotted systems is performed by wetting the sponge, and/or bending the sponge and backplate in order to align the locking clips with the corresponding attachment means on the base plate. For example, in U.S. Pat. Nos. 4,468,832 and 4,509,224 to Batchelor, the sponge must be compressed or buckled at its center to attach the sponge refill to the mop clips. This replacement operation is messy, time consuming and may damage the sponge and/or backplate. In addition, if a scrub strip is present on the sponge, the bending may weaken the adhesive bond, thus decreasing the useful life of the sponge refill.

Additionally, mop users may disadvantageously have to use additional tools to remove a refill from the mop head. For example, in U.S. Pat. No. 3,616,481 to Van Spronsen, a medial section of each end border of the sponge backing plate is inwardly inclined to inwardly offset the corresponding end edge wherein a screwdriver may be inserted to allow the mop clips to be removed from the coupling members.

Accordingly, an object of the present invention to provide a universal sponge mop refill cartridge which is relatively easy to replace without tools for mop heads having mop clips, turn-lock assemblies or long slotted attachment means.

A further object of the present invention is to provide a universal sponge mop refill cartridge which remains secure on the mop head during mopping operations.

SUMMARY DISCLOSURE OF THE INVENTION

The present invention overcomes the disadvantages of current sponge mops, in that it provides a sponge refill backplate for easy replacement on mop heads having mop clips, turn-lock assemblies and long slotted attachment means without wetting or bending the sponge and backplate or needing additional tools. This is accomplished by providing a backplate having opposed raised locking clips open only at their distal ends having locking slots long enough to allow a mop clip to extend far enough into the locking clip to allow the outer edge of the opposite locking clip to properly align its mop clip; and a pair of locking ramps located at the open distal end of each locking clip, inwardly sloped towards the open end of the locking clip to assist in loading the refill. When the sponge refill is fully engaged on the two clips, the high ends of the ramps to act as a stop means for keeping the mop clips centered on the mop head by cooperating with the underside of the base plate, but which also may be overridden by a predetermined force in the longitudinal direction of the mop head. This backplate is especially advantageous for the arthritic or the elderly person who may not have sufficient hand strength to properly bend current sponge refill backplates.

BEST MODE FOR CARRYING OUT THE INVENTION

Figure 2:
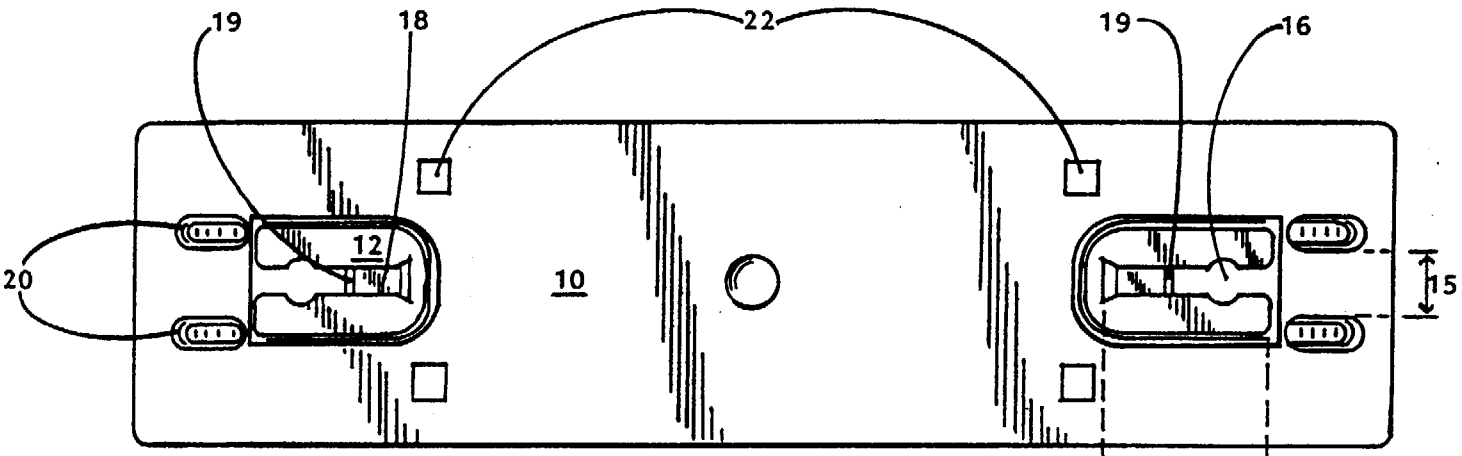
FIG. 2 is a top view of the preferred sponge backplate.
Figure 4:
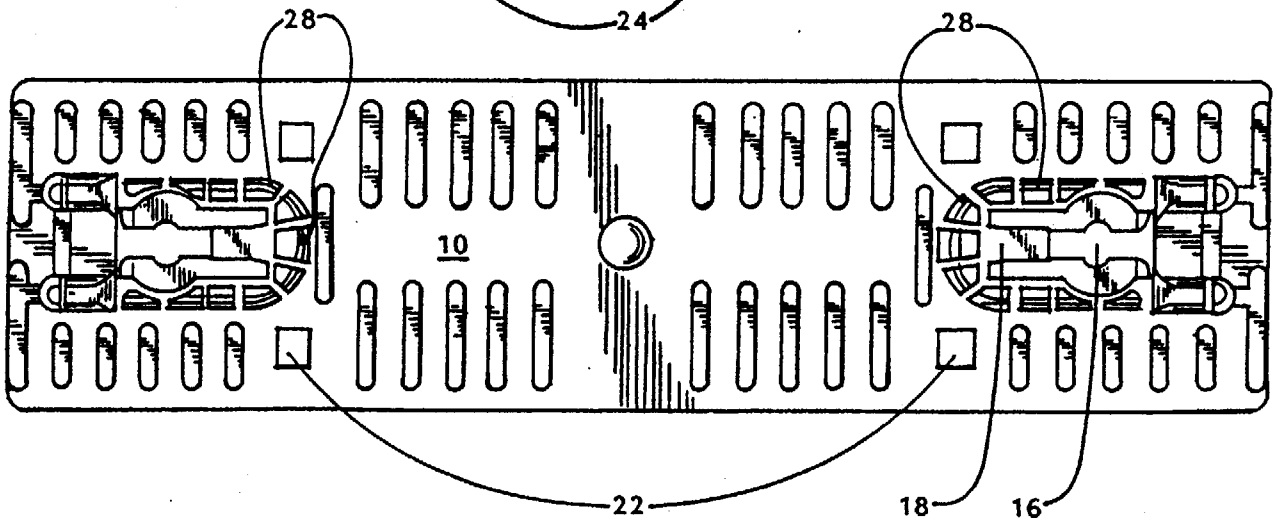
FIG. 4 is a bottom view of the preferred embodiment of the backplate.

FIGS. 2 and 4 show the preferred embodiment of sponge refill backplate of the present invention having opposed raised locking clips 12 open at their distal ends only. Each locking clip 12 has opposed top wall portions forming thereinbetween a narrow locking slot 14 and further forming a wide channel 15 between the top wall portions and the backplate. A pair of locking ramps 20 located at the open distal end of each locking clip 12 and angled inwardly toward the wide channel 15 are also provided on the backplate 10. For mop heads with mop clips, the locking clip 12 may also comprise a flexible tongue 18 which sits in the wide channel 15 below the locking slot 14 and is attached at the closed end of the locking clip.

In use, the sponge mop refill is assembled on the base plate of a sponge mop by sliding the refill backplate 10 over one of the two attachment means on the base plate in a longitudinal direction, allowing the backplate 10 to fall back against the frame with the second attachment means aligned in the opening of the opposite locking clip, and then sliding the refill back to the center position. No bending of the backplate or the sponge is required.

One type of commonly available means for attaching a sponge mop refill cartridge onto a sponge mop base plate is mop clips (not shown). Mop clips generally comprise outwardly projecting coupling buttons having enlarged rectangular heads which are slideably engaged by the narrow locking slot 14 of the backplate of FIGS. 2, 3 and 4. The width of locking slot 14 is sufficient to allow a mop clip to readily slide in slot 14 yet remain securely engaged therein during use of the mop. Locking slot 14 is typically about 0.175 to about 0.220 inches, preferably about 0.204 inches wide. Wide channel 15 is of sufficient width to receive the mop clip while locking slot 14 holds the mop clip in place. Typically, wide channel 15 is from about 0.425 inches to about 0.536 inches, preferably about 0.446 inches wide.

Figure 1:
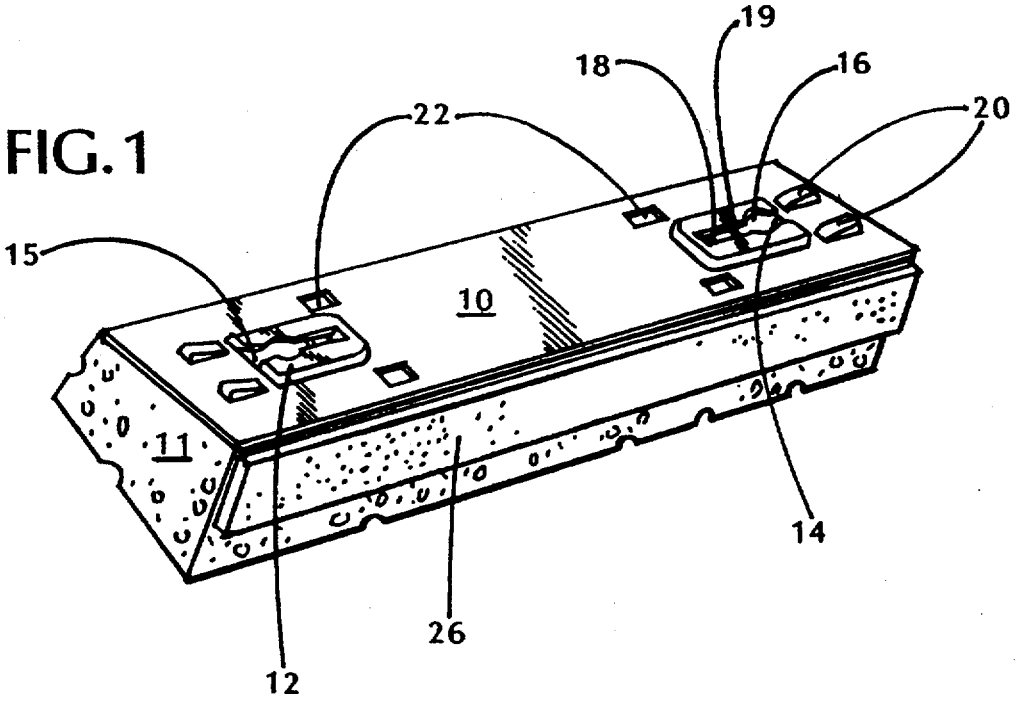
FIG. 1 is a three-quarter perspective view of a sponge refill cartridge having a scrub strip.

As the mop clip is slid into the locking slot 14, the flexible tongue 18 engages the mop clip such that the mop clip sits between the tongue 18 and the bottom surface of the locking slot 14. Tongue 18 also provides an additional pressure point within the locking clip to prevent accidental disengagings during use of a mop head. As shown in FIGS. 1, 2 and 4, preferably, tongue 18 has elevated rib 19 towards the end of its top surface. Tongue 18 is typically from about 0.35 inches to about 0.50 inches, preferably, about 0.442 inches in length; from about 0.200 inches to about 0.3 inches, preferably about 0.208 inches in width; and from about 0.035 inches to about 0.170 inches, preferably about 0.080 inches in height at the elevated rib position, preferably about 0.045 inches at the flat position.

Locking slot 14 is long enough so that one of the two attachment means such as a mop clip or long slot (not shown) can pass far enough into locking clip 12 to allow the outer side of the opposite locking clip to fall into place at its attachment means without bending the backplate or sponge 11. Accordingly, locking slot 14 is typically from about 0.975 inches to about 1.2 inches, preferably from about 1.015 to about 1.128 inches, and most preferably about 1.08 inches in length.

Optionally, the locking slot 14 may also define keyways 16 as shown in FIGS. 2 and 4 to accommodate a turn lock assembly (not shown) like the one described in U.S. patent application Ser. No. 08/094,820 to Teufel et al. filed on Jul. 20, 1993. To further accommodate a mop head with a turn lock assembly, the backplate may further comprise aligning holes 22 as shown in FIGS. 1, 2 and 4 to accommodate the aligning pins (not shown) on the mop base plate.

Referring to FIGS. 1–4, locking ramps 20 assist the backplate slide into place on the mop base plate by cooperating with the underside of a mop base plate which typically has curved edges. When the refill is overshot over the second of the two attachment means, the ramp is held up and away on its high end allowing its adjacent locking clip to align with the second attachment means. Very little force in the longitudinal direction is needed to return the refill to the center position to allow the second attachment means to pass into its locking clip. Thus, the ramp allows the refill on the return trip to load easily with the application of little force.

The locking ramps 20 provided on the sponge refill backplate of the present invention also act as an additional stop means for mop heads having mop clips or long slotted attachment means when the assembly is completed over the locking clip system of the present invention. The high ends of the ramps 20 hold the backplate in place by butting up against the frame of the mop head. When the sponge refill needs to be replaced, locking ramps 20 may be overridden by a predetermined force applied in the longitudinal direction of the mop head.

The locking ramps are generally from about 0.1 to about 0.21 inches, preferably 0.145 inches in height; generally from about 0.160 inches to about 0.245 inches, preferably 0.205 inches in width; and from about 0.425 to about 0.52 inches, preferably about 0.475 inches in length. Each pair of locking ramps are also generally arranged at their high ends from about 0.495 inches to about 0.545 inches, preferably from about 0.510 inches to about 0.525 inches, and most preferably about 0.520 inches from the distal opening of the locking clip. Further, each pair of locking ramps are typically arranged from about 0.3 inches to about 0.35 inches, preferably from about 0.31 inches to about 0.33 inches, most preferably about 0.3295 inches from a line through their respective center points running parallel to each other.

Figure 3:
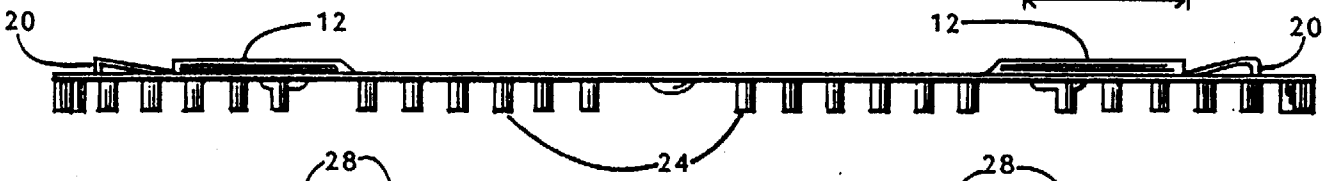
FIG. 3 is a side view of the sponge backplate, the opposite side being the mirror image thereof.

Referring to FIG. 3, the locking ramps are angled inwardly towards wide channel 15 and locking slot 14 at a slope from about 20° to about 30°, most preferably about 21°.

Preferably, as shown in FIG. 4, the underside of the locking clip has a honeycomb system of ribs 20 to reduce the stress on the top wall of the locking clip by the attachment means thus preventing premature breakage of the locking clip. As shown in FIG. 2, the outer wall of locking clip 12 is preferably outwardly slanted along its peripheral edge in order to further reduce the stress on the locking clip and to accommodate the honeycomb system 28.

The sponge backplate is preferably constructed of thermoplastic materials, such as polyolefins, so as to permit the sponge, which is typically formed from a synthetic plastic such as polyurethane or a wood-based cellulose material, to be thermally sealed to the backplate. This allows the use of heat to attach the sponge 11 to the underside of the backplate 10. Preferably, as shown in FIGS. 2, 3 and 4, raised ribs 24 are provided on the side of the backplate for adhering a sponge to the backplate 10 by hydrasealing whereby the ribs 24 melt into the sponge. A complete sponge refill cartridge with sponge 11 and scrub strip 26 is shown in FIG. 1.

INDUSTRIAL APPLICABILITY

The same sponge refill backplate can be used with mop heads having mop clips, turn-lock assemblies and long-slotted attachment means to economically produce a number of different sponge mops.

Other modifications and variations of the present invention will become apparent to those skilled in the art from an examination of the above Specification and Drawings. Therefore, other variations of the present invention may be made which fall within the scope of the appended claims even though such variations were not specifically discussed above.

What I claim is:

1. A backplate for a mop refill, the backplate having first and second ends, a first side, and a second, opposing side, the backplate comprising:

a pair of raised locking clips, each locking clip having a narrow locking slot formed therein and a wide channel opening, the locking clips being oppositely disposed proximate the first and second ends on the first side of the backplate, the wide channel openings being located at one end of the locking slots proximate the corresponding backplate end, each locking slot for receiving an attachment means at its wide channel opening, the locking slots being of sufficient length to allow the corresponding attachment means to pass far enough into the locking clip to allow an outer edge of the opposite locking clip to align with its corresponding attachment means without bending the backplate; and a pair of locking ramps positioned proximate the wide channel opening of each locking clip, one end of the locking ramps being spaced from the backplate first side and sloping toward the backplate first side and the wide channel opening, and capable of keeping the backplate securely fastened to a mop head during mopping operations.

2. The backplate as claimed in claim 1, wherein the locking slot has a length from about 0.975 inches to about 1.2 inches.

3. The backplate as claimed in claim 1, wherein the locking slot has a length about 1.08 inches.

4. The backplate as claimed in claim 1, wherein the slope of the locking ramps toward the backplate first side and the wide channel opening is from about 20° to about 30°.

5. The backplate as claimed in claim 1, wherein the slope of the locking ramps toward the backplate first side and the wide channel opening is about 21°.

* * * * *